US011898281B2

(12) United States Patent
Jang

(10) Patent No.: US 11,898,281 B2
(45) Date of Patent: Feb. 13, 2024

(54) CLOTHING-MANUFACTURING KNITTING MACHINE

(71) Applicant: Kookmin University Industry Academy Cooperation Foundation, Seoul (KR)

(72) Inventor: Jung Sik Jang, Gyeonggi-do (KR)

(73) Assignee: Kookmin University Industry Academy Cooperation Foundation, Seoul (KR)

( * ) Notice: Subject to any disclaimer, the term of this patent is extended or adjusted under 35 U.S.C. 154(b) by 211 days.

(21) Appl. No.: 17/426,655

(22) PCT Filed: Nov. 6, 2020

(86) PCT No.: PCT/KR2020/015455

§ 371 (c)(1),
(2) Date: Jul. 29, 2021

(87) PCT Pub. No.: WO2022/097782

PCT Pub. Date: May 12, 2022

(65) Prior Publication Data

US 2022/0372680 A1 Nov. 24, 2022

(30) Foreign Application Priority Data

Nov. 5, 2020 (KR) ..... 10-2020-0146558

(51) Int. Cl.
*D04B 15/82* (2006.01)
*D04B 15/94* (2006.01)

(52) U.S. Cl.
CPC ..... *D04B 15/82* (2013.01); *D04B 15/94* (2013.01)

(58) Field of Classification Search
CPC ..... D04B 15/22; D04B 15/36; D04B 15/82; D04B 15/94; D04B 15/96
(Continued)

(56) References Cited

U.S. PATENT DOCUMENTS 2,348,932 A * 5/1944 De Hart ..... D04B 35/04 66/13
3,572,056 A * 3/1971 Radin ..... D04B 15/82 66/57

(Continued)

FOREIGN PATENT DOCUMENTS

EP 0235987 9/1987
EP 0516048 12/1992

(Continued)

OTHER PUBLICATIONS

Supplementary European Search Report and the European Search Opinion dated Sep. 7, 2022 From the European Patent Office Re. Application No. 20914767.7. (8 Pages).

(Continued)

*Primary Examiner* — Aiying Zhao

(57) ABSTRACT

A knitting machine for clothing has a needle module with a plurality of needle units. Each of the needle units has a needle hook and a plurality of protrusions. The machine also has a first actuation module with a carriage that has a track to connect to one of the protrusions. The carriage can move left and right, and this movement moves the needle units in a longitudinal direction. The machine also has a second actuation module with a connector that has a screw thread to mesh with another one of the protrusions. The connector can move up and down, and this movement moves the needle units.

5 Claims, 5 Drawing Sheets

(58) Field of Classification Search
USPC ..... 66/72, 78
See application file for complete search history.

(56) References Cited

U.S. PATENT DOCUMENTS

| | | | | | |
|---|---|---|---|---|---|
| 3,614,879 | A * | 10/1971 | Suppe | ..... | D04B 11/32 66/78 |
| 4,559,791 | A * | 12/1985 | Schimko | ..... | D04B 15/10 66/75.1 |
| 6,810,695 | B1 * | 11/2004 | Wang | ..... | D04B 15/82 66/57 |

FOREIGN PATENT DOCUMENTS

| | | | | | |
|---|---|---|---|---|---|
| GB | 2077776 | | 12/1981 | | |
| GB | 2209039 | | 4/1989 | | |
| JP | 2003221767 | A * | 8/2003 | | |
| JP | 2019-073818 | | 5/2019 | | |
| JP | 2019073818 | A * | 5/2019 | ..... | D04B 15/70 |
| KR | 10-1674546 | | 11/2016 | | |
| KR | 10-1866451 | | 6/2018 | | |
| KR | 10-2019-0041407 | | 4/2019 | | |

OTHER PUBLICATIONS

International Search Report and the Written Opinion dated Jul. 29, 2021 From the International Searching Authority Re. Application No. PCT/KR2020/015455 and Its Translation of Search Report Into English. (8 Pages).

Hudson "Printing Teddy Bears: A Technique for 3D Printing of Soft Interactive Objects", Proceedings of the SIGCHI Conference on Human Factors in Computing Systems, CHI'14, Toronto, Ontario, Canada, Apr. 26-May 1, 2014, p. 459-468, Apr. 26, 2014.

* cited by examiner (a)

(b)

CLOTHING-MANUFACTURING KNITTING MACHINE

RELATED APPLICATIONS

This application is a National Phase of PCT Patent Application No. PCT/KR2020/015455 having International filing date of Nov. 6, 2020, which claims the benefit of priority of Korean Patent Application No. 10-2020-0146558 filed on Nov. 5, 2020. The contents of the above applications are all incorporated by reference as if fully set forth herein in their entirety.

FIELD AND BACKGROUND OF THE INVENTION

The disclosure relates to a clothing-manufacturing knitting machine, and more particularly to a clothing-manufacturing knitting machine of which a needle for manufacturing clothing is moved forward and backward by a conventional carriage and a new actuation structure.

In general, a flat-knitting machine or the like knitting machine is employed to manufacture clothing. The flat-knitting machine knits cloth with a programmed pattern while a carriage feeds a plurality of needles arranged in a needle unit with threads by reciprocating left and right above the needle unit. A principle of actuating a conventional flat-knitting machine is as follows. The needle of the needle unit is formed with a protrusion, and the carriage is formed with a track corresponding to the protrusion on the rear thereof, so that the protrusion can move along the track while the carriage reciprocates. With this structure, the needles move forward or backward as a whole, thereby performing knitting.

However, a conventional knitting machine has had a problem that the carriage needs to move the needle unit forward and backward while reciprocating between both ends of the arranged needle unit, and it is therefore impossible to separately move only a specific needle unit forward and backward.

An aspect of the disclosure is to solve such conventional problems, and provide a hybrid clothing-manufacturing knitting machine with an actuating system using the existing carriage and a new actuating system.

Another aspect of the disclosure is to provide a clothing-manufacturing knitting machine in which only a specific needle is separately movable forward and backward while using the carriage.

SUMMARY OF THE INVENTION

According to an embodiment of the disclosure, there is provided a knitting machine for clothing, the knitting machine including: a needle module in which a plurality of needle units are arranged side by side, the needle unit including a needle hook formed in an end portion and a plurality of protrusions formed in a middle region; a first actuation module including a carriage for a flat-knitting machine, a rear of which is formed with a track to be linked with one of the plurality of protrusions, and provided to be movable left and right; a second actuation module including a connector formed with a screw thread for meshing with another one of the plurality of protrusions, and an actuator for actuating the connector to move, and provided to be movable left and right; a first movement unit allowing the first actuation module to move up and down to be in contact with the needle module; and a second movement unit allowing the connector of the second actuation module to move up and down with respect to the needle module, wherein, when the protrusion of the needle unit is linked to the track as the first movement unit moves the first actuation module toward the needle module, the needle unit moves forward or backward by the connection between the track of the carriage and the protrusion as the carriage moves left and right, and wherein, when the second movement unit moves the connector of the second actuation module toward the needle module, the needle unit meshing with the screw thread moves forward or backward as the actuator actuates the connector to rotate while the screw thread is connecting with the protrusion of the needle unit.

Here, the protrusion of the needle unit may include two protrusions of a first protrusion and a second protrusion, the first protrusion corresponding to the first actuation module and the second protrusion corresponding to the second actuation module.

The knitting machine for clothing may further include a selector to selectively move the needle unit up and down.

Here, the selector comprises a solenoid valve and selectively moves the needle unit up and down.

Further, the connector may include a plurality of connectors arranged side by side, and the connectors are fewer than the needle units.

The actuator of the second actuation module may be rotatable forward and backward, and include an encoder to sense the number of rotations, thereby controlling the number of rotations of the actuator.

The first actuation module and the second actuation module may together move left and right. Alternatively, the first actuation module and the second actuation module may individually move left and right.

According to the disclosure, there is provided a clothing-manufacturing knitting machine with an actuating system using the existing carriage and a new actuating system.

Further, there is provided a clothing-manufacturing knitting machine in which only a specific needle unit is separately movable forward and backward while using the carriage Further, there is provided a clothing-manufacturing knitting machine in which forward and backward movement of a needle unit is freely adjustable.

DESCRIPTION OF SPECIFIC EMBODIMENTS OF THE INVENTION

In description of various embodiments, like elements referenced by like numerals will be representatively described in a first embodiment, and other elements different from those of the first embodiment will be described in other embodiments.

Below, a clothing-manufacturing knitting machine according to a first embodiment of the disclosure will be described in detail with reference to the accompanying drawings.

Figure 1:
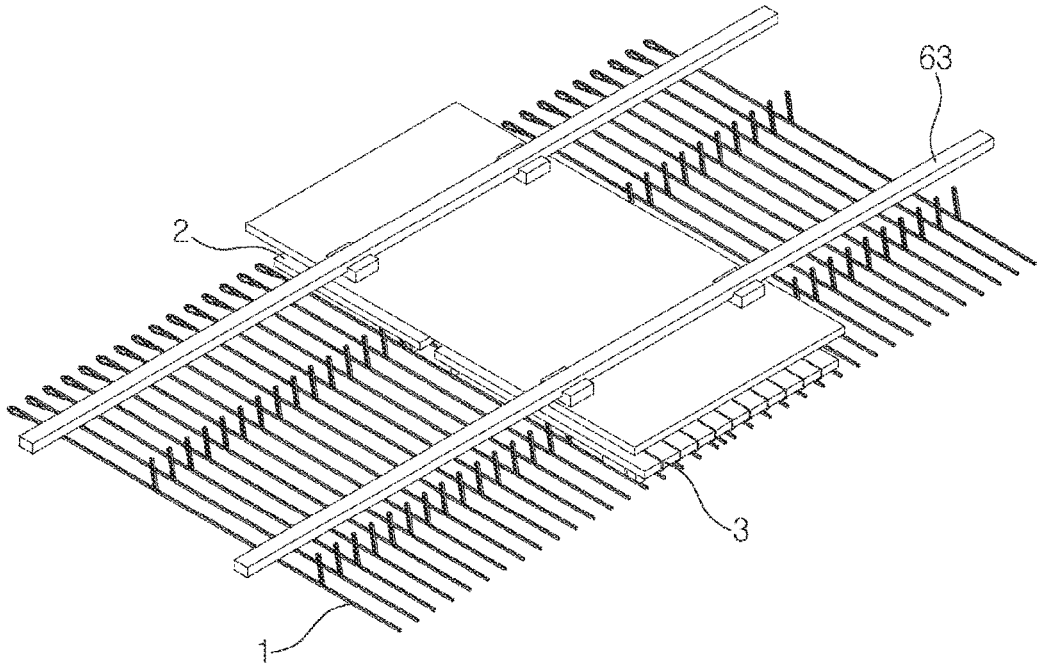
FIG. 1 is a perspective view illustrating a main configuration of a clothing-manufacturing knitting machine according to the disclosure.
Figure 2:
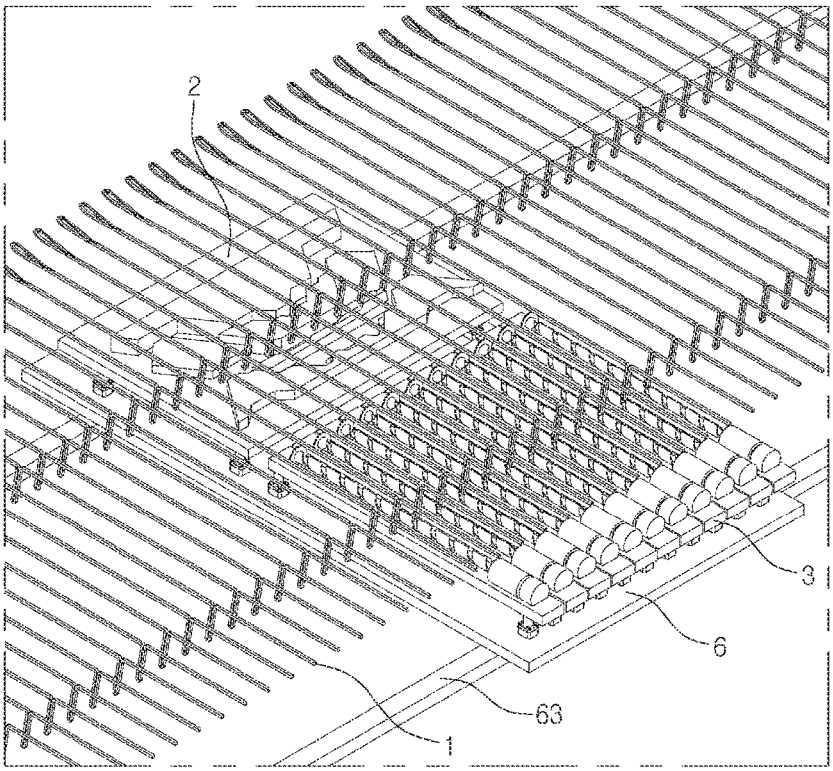
FIG. 2 is a perspective view illustrating first and second actuation modules of a clothing-manufacturing knitting machine according to the disclosure.

FIG. 1 is a perspective view illustrating a main configuration of a clothing-manufacturing knitting machine according to the disclosure, and FIG. 2 is a perspective view illustrating first and second actuation modules of a clothing-manufacturing knitting machine according to the disclosure. As shown therein, the clothing-manufacturing knitting machine according to the disclosure includes a needle module 1, a first actuation module 2, a second actuation module 3, a first movement unit 4, a second movement unit 5, and a supporter 6.

Figure 3:
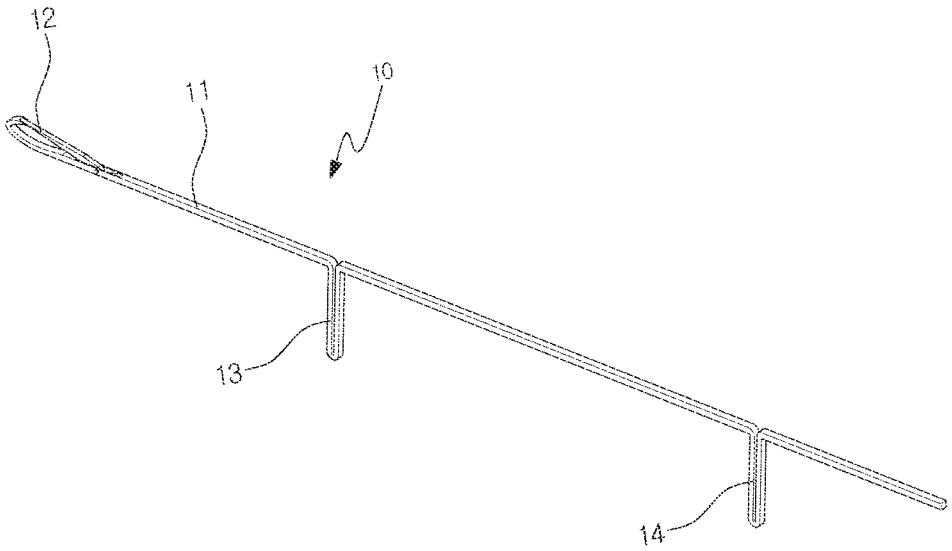
FIG. 3 is a perspective view of a needle unit of the clothing-manufacturing knitting machine according to the disclosure.

FIG. 3 is a perspective view of a needle unit. As shown therein, the needle section module 1 includes a plurality of needle units 10 arranged side by side, and one needle unit 10 includes a main body 11 formed long in a lengthwise direction, a needle hook 12 formed at one end of the main body 11 and hooking a thread, and a first protrusion 13 and a second protrusion 14 formed in certain regions of the main body 11. The needle hook 12 has a structure by which a thread positioned in front thereof is hooked as the needle unit 10 is moved forward, and the hooked thread is pulled backward as the needle unit 10 is moved backward. The first protrusion 13 and the second protrusion 14 protrude outward from the certain regions of the main body 11 and mesh with the first actuation module 2 and the second actuation module 3, respectively.

Figure 4:
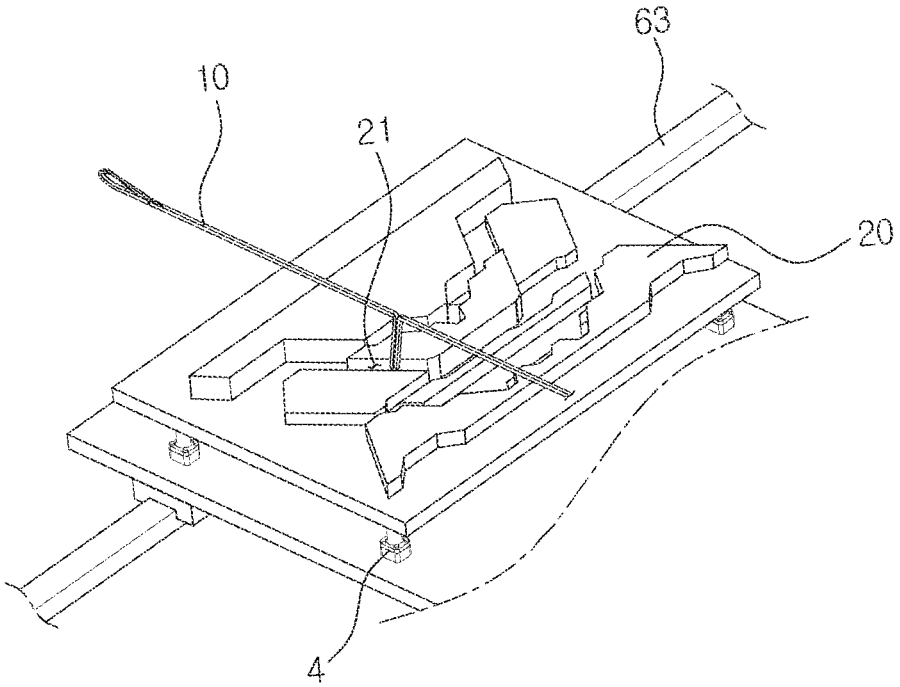
FIG. 4 is a perspective view showing coupling between a first actuation module and a needle unit of a clothing-manufacturing knitting machine according to the disclosure.

FIG. 4 is a perspective view of a first actuation module. As shown therein, the first actuation module 2 includes the features of the carriage 20 used in the existing flat-knitting machine. In other words, a track 21 for inserting the first protrusion 13 therein is formed on the rear of the carriage 20 moving left and right on the needle module 1. Therefore, the first protrusion 13 moves along the track 21 as the carriage 20 moves left and right on the needle module 1, thereby moving the needle unit 10 forward and backward.

Figure 5:
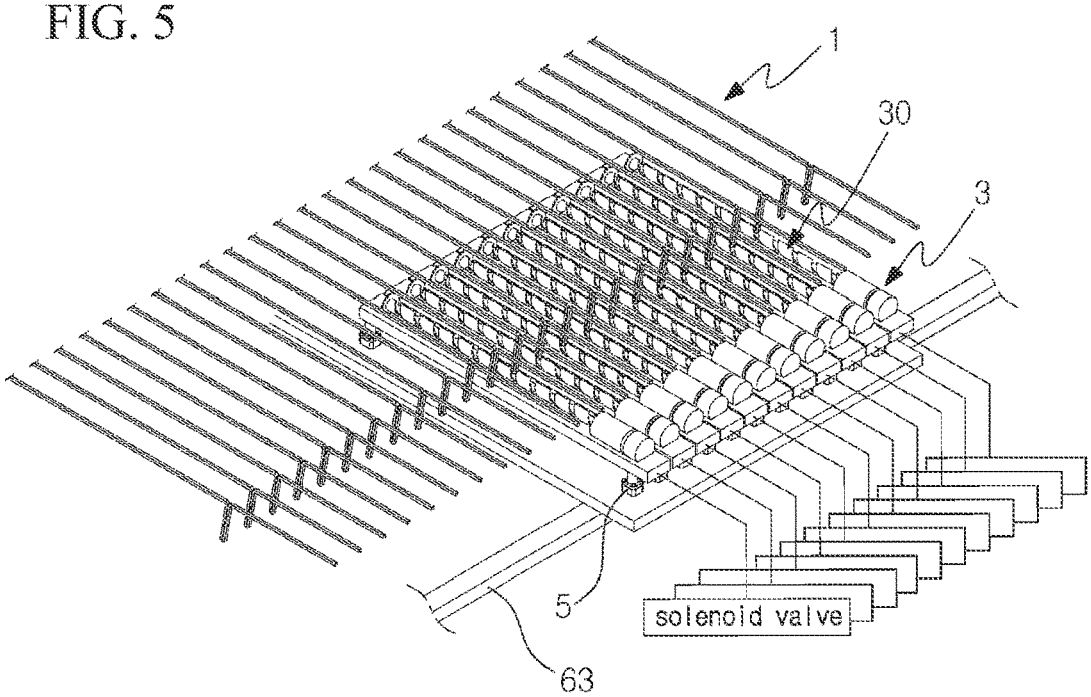
FIG. 5 is a perspective view showing coupling between a second actuation module and a needle unit of a clothing-manufacturing knitting machine according to the disclosure.
Figure 6:
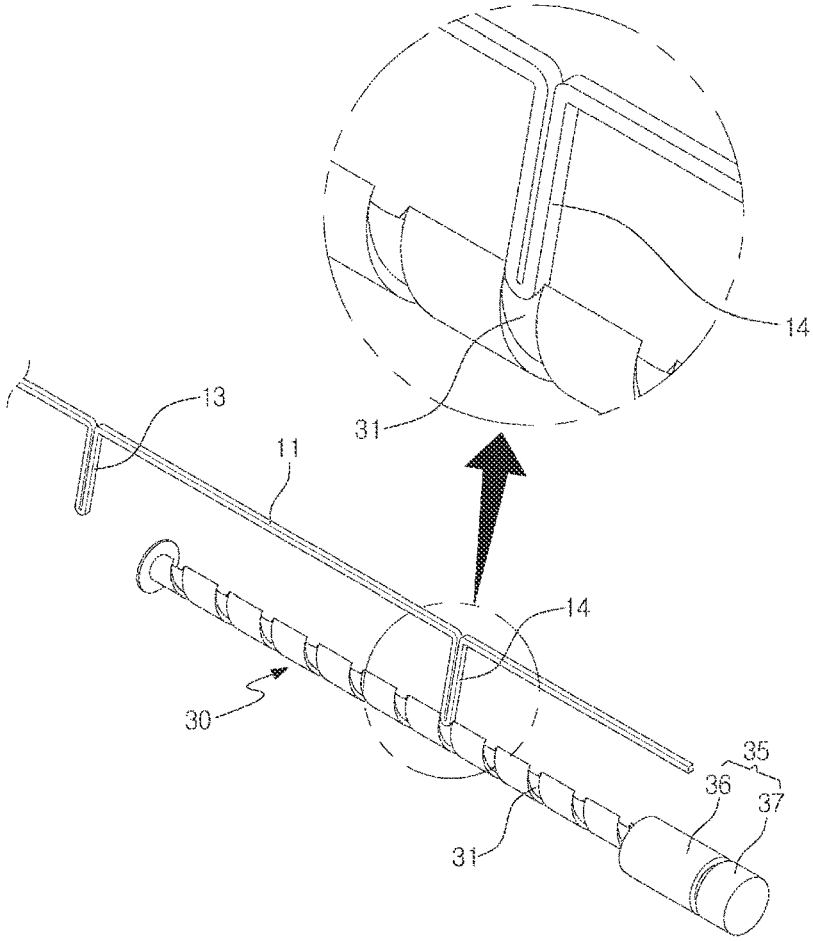
FIG. 6 is a perspective view of a connector of a clothing-manufacturing knitting machine according to the disclosure.
Figure 7:
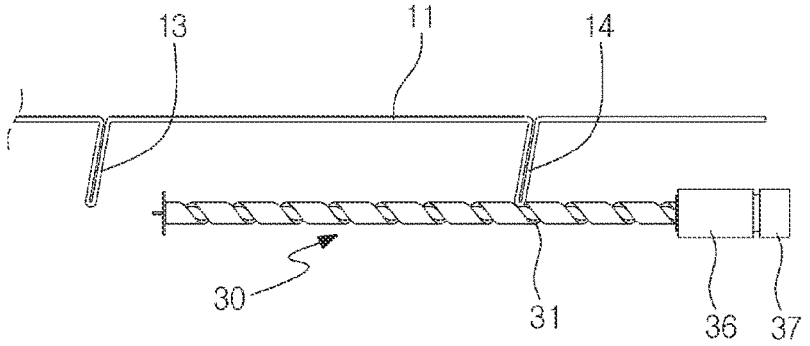
FIG. 7 is an operational view illustrating operation of a second actuation module of a clothing-manufacturing knitting machine according to the disclosure.
Figure 7:
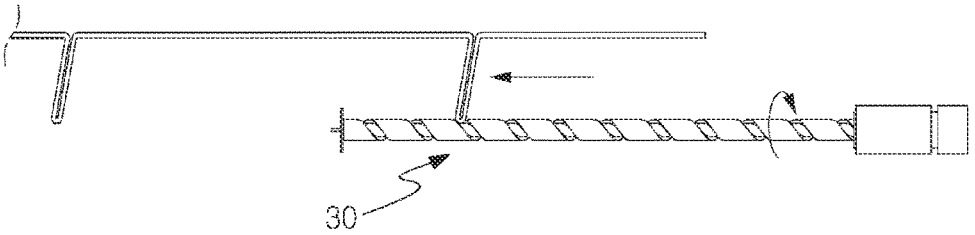

FIG. 5 is a perspective view of a second actuation module. As shown therein, the second actuation module 3 includes a connector 30 formed with a screw thread 31 to mesh with the second protrusion 14, and an actuator 35 for rotating the connector 30. The connector 30 transmits a rotational force generated by the actuator 35 to the needle unit 10 so that the needle unit 10 can move forward and backward, and has a body formed with a screw thread 31 with which the second protrusion 14 of the needle unit 10 meshes.

A width of a groove of the screw thread 31 may be the same as or a little wider than the width of the second protrusion 14 of the needle unit 10, so that the second protrusion 14 of the needle unit 10 can be inserted in the groove. Therefore, when the connector 30 rotates, the second protrusion 14 of the needle unit 10 inserted in the groove of the screw thread 31 moves forward or backward along the screw thread 31 while interlocking with the rotation of the connector 30. The forward or backward moving distance of the needle unit 10 is varied depending on the number of rotations of the connector 30.

The actuator 35 is embodied by a motor 36 that can rotate the connector 30. In this embodiment, the motor is described by way of example. However, any actuator may be used as long as it can rotate the connector 30. Further, the actuator 35 may include an encoder 37 to sense the number of rotations of the connector 30 and control the forward and backward moving distance of the needle unit 10.

The connectors 30 may be provided fewer than the needle units 10, and be selectively in contact with the individual needle units 10 while the connector 30 moves left and right within the arrangement of the needle module 1, thereby transmitting an actuation force to the needle unit 10.

The first movement unit 4 is provided to move the first actuation module 2 closer to or far away from the needle module 1. In other words, when the needle unit 10 of the needle module 1 is actuated by the first actuation module 2, the first movement unit 4 moves the first actuation module 2 toward the needle module 1 so that the first protrusion 13 of the needle unit 10 can be inserted in the track 21 formed in the carriage 20 of the first actuation module 2. Therefore, like the operation of the general flat-knitting machine, the needle unit 10 moves forward and backward as the carriage 20 moves left and right. When the second actuation module 3 operates, the first actuation module 2 needs to be released from the first protrusion 13 in order to avoid interference, and therefore the first movement unit 4 moves the first actuation module 2 far away from the needle module 1, thereby releasing the first actuation module 2 from the needle module 1.

The second movement unit 5 is provided to move the second actuation module 3 closer to or far away from the needle module 1. In other words, when the needle unit 10 of the needle module 1 is actuated by the second actuation module 3, the second movement unit 5 moves the second actuation module 3 toward the needle module 1 so that the second protrusion 14 of the needle unit 10 can be in contact with the connector 30 of the second actuation module 3. Therefore, the needle unit 10 moves forward and backward based on the operation of the connector 30. When the first actuation module 2 operates, the second actuation module 3 needs to be released from the second protrusion 13 in order to avoid interference, and therefore the second movement unit 5 moves the second actuation module 3 far away from the needle module 1, thereby releasing the second actuation module 3 from the needle module 1.

The second movement unit 5 may be actuated by a solenoid valve to move each individual connector 30 up and down. In other words, the solenoid valves are respectively connected to the connectors 30, and individually move the connectors 30 up and down, thereby individually moving the needle units 10 forward and backward.

Therefore, above the needle module 1, the first actuation module 2 and the second actuation module 3 are respectively positioned corresponding to the first protrusion 13 and the second protrusion 14, and the first movement unit 4 and the second movement unit 5 are respectively arranged to move the first actuation module 2 and the second actuation module 3 up and down.

Further, the supporter 6 may be provided to not only support the first actuation module 2 and the second actuation module 3 but also move the first actuation module 2 and the second actuation module 3 left and right above the needle module 1. The supporter 6 supports the first actuation module 2 and the second actuation module 3 to move left and right together. The supporter 6 includes a first supporting member 61 and a second supporting member 62, and the first supporting member 62 is mounted onto a rail 63 and movable left and right, i.e., in a direction intersecting a lengthwise direction of the needle unit 10. On the first supporting member 61, the first actuation module 2 is supported by the first movement unit 4, and at the same time the second supporting member 62 is supported by the second movement unit 5.

The second supporting member 62 is provided as many as the number of connectors 30 and the number of actuators 35, installed with the connectors 30 and the actuators 35, and moved by the second movement unit 5 up and down from the first supporting member 61. In other words, the second movement unit 5 is actuated by the solenoid valve to move the second supporting member 62 up and down. Therefore, the second movement unit 5 actuates the second supporting member 62 to independently move up and down, so that the connector 30 and the needle unit 10 can mesh with or be released from each other for linking or unlinking.

From now on, the actuation of the clothing-manufacturing knitting machine according to the disclosure will be described.

Figure 8:
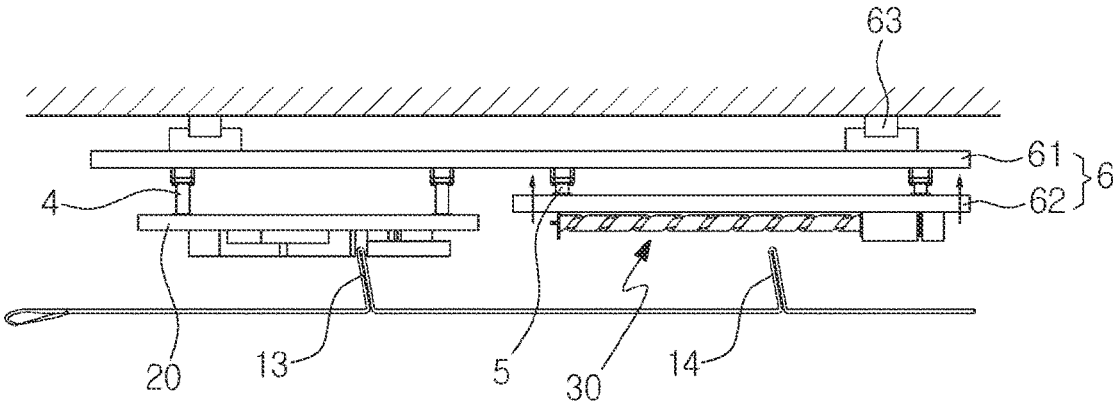
FIG. 8 is an operational view illustrating operation of a clothing-manufacturing knitting machine according to the disclosure.
Figure 9:
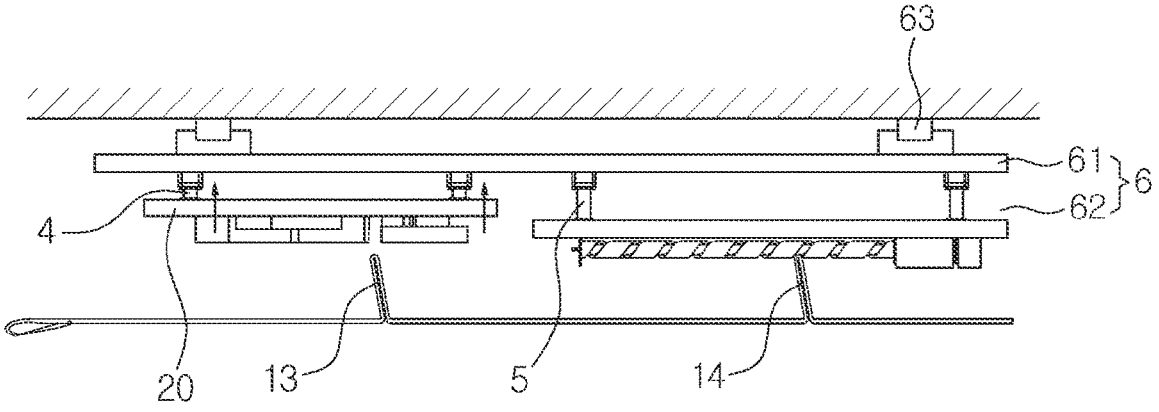
FIG. 9 is an operational view illustrating operation of a clothing-manufacturing knitting machine according to the disclosure.

FIGS. 8 and 9 are operational views illustrating operation of a clothing-manufacturing knitting machine according to the disclosure.

As shown therein, to move the needle unit 10 forward and backward, the first actuation module 2 is first moved toward the needle module 1 by the first movement unit. Therefore, the first protrusion 13 of the needle unit 10 is inserted in the track 21 of the carriage 20 of the first actuation module 2. When the first actuation module 2 moves left and right with the first but 13 inserted in the track 21, the needle unit 10 moves toward the thread or backward along the pattern of the track 21. The forward or backward movement of the needle unit 10 is the same as that of the needle unit of a general flat-knitting machine. Therefore, it is possible to manufacture clothing or the like shaped as desired based on the pattern of the track 21. In this case, the second actuation module 3 keeps a distance from the protrusions 13 and 14 of the needle unit 10 so as not to affect the operations of the first actuation module 2.

Next, the operations of the second actuation module 3 will be described. To operate the second actuation module 3, the second actuation module 3 is moved toward the needle module 1 by the second movement unit 5. In this case, the first actuation module 2 keeps a distance from the needle module 1 in order to avoid interference.

As the second actuation module 3 approaches the needle module 1, the connector 30 also moves toward the needle unit 10, and the second protrusion 14 of the needle unit 10 is inserted in the grove of the screw thread 31 of the connector 30. Then, the actuator 35 actuates the connector 30 to rotate, and the rotation of the connector 30 causes the second protrusion 14 meshing with the screw thread 31 to move forward, thereby moving the needle unit 10 forward. At this time, the number of rotations of the connector 30 is sensed by the encoder 37, and the forward moving distance of the needle unit 10 is adjusted based on the number of rotations of the connector 30.

When the needle unit 10 moves forward up to a given position, the thread is hooked to the needle hook 12 of the needle unit 10. Then, the actuator 35 is reversely rotated to move the needle unit 10 backward, and therefore the thread hooked to the needle hook 12 is also moved backward. With such an actuation mechanism, the needle unit 10 moves forward and backward to perform knitting, and the second actuation module 3 reciprocates left and right to manufacture clothing having a desired size or a desired shape.

Because the second movement unit 5 individually moves the connector 30 up and down by the solenoid valve, the needle unit 10 is selectively moved forward or backward. In other words, by the individual operation of the solenoid valve, only the second supporting member 62, of which the corresponding solenoid valve works, is moved toward the needle unit 10 among the second supporting members 62 of the supporter 6. Then, the connector 30 supported on the second supporting member 62 moved by the operation of the second movement unit 5 is moved toward the needle unit 10, but the connectors 30 corresponding to the second supporting member 62, of which the corresponding solenoid valves do not work, stay in place without moving toward the needle unit 10. Therefore, the second protrusion 14 of the needle unit 10 is inserted in the groove of the screw thread 31 of the selected connector 30. Then, the actuator 35 actuates the selected connector 30 to rotate, and the rotation of the connector 30 causes the second protrusion 14 meshing with the screw thread 31 to move forward, thereby moving only the selected needle unit 10 forward or backward. In this manner, not all the needle units 10 but only the selected needle unit 10 is selectively moved forward and backward.

In other words, the first actuation module 2 actuates all the needle units 10 corresponding to a certain corresponding region to move forward or backward along the track 21 as the first protrusion 13 is connected to the track 21, but the second actuation module 3 selectively actuates the needle unit 10 to move forward or backward and controls the forward or backward moving distance of the needle unit 10 by adjusting the rotation amount of the connector 30. Therefore, the second actuation module 3 is used in knitting a knitting structure having a specific shape while clothing is manufactured.

The scope of the disclosure is not limited to the foregoing embodiments, but may be embodied in various forms within the scope of the appended claims. The scope of the claims appended in the disclosure falls within various scopes in which any changes can be made by a person having ordinary knowledge in the art to which the disclosure pertains, without departing from the gist of the disclosure defined in the claims.

There is provided a knitting machine for clothing, the knitting machine including: a needle module in which a plurality of needle units are arranged side by side, the needle unit including a needle hook formed in an end portion and a plurality of protrusions formed in a middle region; a first actuation module including a carriage for a flat-knitting machine, a rear of which is formed with a track to be linked with one of the plurality of protrusions, and provided to be movable left and right; a second actuation module including a connector formed with a screw thread for meshing with another one of the plurality of protrusions, and an actuator for actuating the connector to move, and provided to be movable left and right; a first movement unit allowing the first actuation module to move up and down to be in contact with the needle module; and a second movement unit allowing the connector of the second actuation module to move up and down with respect to the needle module, wherein, when the protrusion of the needle unit is linked to the track as the first movement unit moves the first actuation module toward the needle module, the needle unit moves forward or backward by the connection between the track of the carriage and the protrusion as the carriage moves left and right, and wherein, when the second movement unit moves the connector of the second actuation module toward the needle module, the needle unit meshing with the screw thread moves forward or backward as the actuator actuates the connector to rotate while the screw thread is connecting with the protrusion of the needle unit.

The invention claimed is:

1. A knitting machine for clothing, comprising:

a needle module in which a plurality of needle units are arranged side by side, each one of the plurality of needle units comprising:

a main body, a needle hook formed in an end portion of the main body, and a plurality of protrusions formed in a middle region of the main body;

a first actuation module comprising a carriage, a rear of the carriage being formed with a track to be linked with a first protrusion of a selected needle unit of the plurality of needle units, and the carriage being provided to be movable left and right;

a second actuation module comprising a connector formed with a screw thread for meshing with a second protrusion of the selected needle unit, and an actuator for actuating the connector to move, and the connector being provided to be movable left and right;

a first movement unit allowing the first actuation module to move up and down to be in contact with the needle module; and a second movement unit allowing the connector of the second actuation module to move up and down with respect to the needle module, wherein, when the first protrusion of the selected needle unit is linked to the track as the first movement unit moves the first actuation module toward the needle module, the selected needle unit moves in a longitudinal direction of a main body of the selected needle unit by a connection between the track of the carriage and the first protrusion of the selected needle unit as the carriage moves left and right, and wherein, when the second movement unit moves the connector of the second actuation module toward the needle module, the selected needle unit meshing with the screw thread that moves in the longitudinal direction of the main body of the selected needle unit as the actuator actuates the connector to rotate while the screw thread is connecting with the second protrusion of the selected needle unit.

2. The knitting machine for clothing according to claim 1, wherein the connector is one of a plurality of connectors which are arranged side by side, wherein the plurality of connectors are fewer than the plurality of needle units.

3. The knitting machine for clothing according to claim 1, wherein the actuator of the second actuation module is rotatable clockwise and counterclockwise, and comprises an encoder to sense a rotation number of the actuator.

4. The knitting machine or clothing according to claim 1, wherein the first actuation module and the second actuation module are provided to reciprocate together in a direction crossing the longitudinal direction of the main body.

5. The knitting machine for clothing according to claim 1, wherein the second movement unit is actuated by a solenoid valve.

* * * * *